US011127377B2

(12) United States Patent
Xu et al.

(10) Patent No.: US 11,127,377 B2
(45) Date of Patent: Sep. 21, 2021

(54) DISPLAY METHOD FOR WHEEL ROTATION IMAGING DEVICE, ELECTRONIC DEVICE AND STORAGE MEDIUM

(71) Applicant: CITIC Dicastal CO., LTD., Hebei (CN)

(72) Inventors: Zuo Xu, Qinhuangdao (CN); Minglei Li, Qinhuangdao (CN); Shiwen Xu, Qinhuangdao (CN); Yao Dai, Qinhuangdao (CN); Weidong Liu, Qinhuangdao (CN); Xi Li, Qinhuangdao (CN); Shaoqian Wang, Qinhuangdao (CN); Liangjian Yue, Qinhuangdao (CN); Dadong Wang, Qinhuangdao (CN); Hongwei Sheng, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 0 days.

(21) Appl. No.: 16/812,598

(22) Filed: Mar. 9, 2020

(65) Prior Publication Data

US 2021/0035532 A1 Feb. 4, 2021

(30) Foreign Application Priority Data

Jul. 30, 2019 (CN) ..... 201910697655.1

(51) Int. Cl.

| | |
|---|---|
| ***G09G 5/37*** | (2006.01) |
| ***G09G 5/02*** | (2006.01) |
| ***G09G 5/10*** | (2006.01) |

(52) U.S. Cl.

CPC ..... *G09G 5/37* (2013.01); *G09G 5/02* (2013.01); *G09G 5/10* (2013.01); *G09G 2354/00* (2013.01)

(58) Field of Classification Search

None

See application file for complete search history.

(56) References Cited

U.S. PATENT DOCUMENTS

| | | | | |
|---|---|---|---|---|
| 8,096,069 | B2 * | 1/2012 | Ishikawa | G03B 21/14 40/591 |
| 2005/0134475 | A1 * | 6/2005 | Reim | G09F 21/045 340/815.45 |

(Continued)

FOREIGN PATENT DOCUMENTS

| | | | |
|---|---|---|---|
| CN | 102445980 | A | 5/2001 |
| CN | 104348980 | A | 2/2015 |

(Continued)

*Primary Examiner* — Tize Ma

(74) *Attorney, Agent, or Firm* — Cooper Legal Group, LLC

(57) ABSTRACT

A display method for a wheel rotation imaging device includes: acquiring operation information, the operation information comprising ambient light intensity, wheel speed, vehicle acceleration, current time, current location, and current power; identifying a situational mode of vehicle driving according to the operation information, the situational mode being in one-to-one correspondence with a power consumption mode; and selecting a power consumption mode of the wheel rotation imaging device according to the situational mode, so that the wheel rotation imaging device completes display according to the power consumption mode. The wheel rotation imaging device is mounted on a wheel and can display texts, images or videos as the wheel rotates.

18 Claims, 5 Drawing Sheets

(56) References Cited

U.S. PATENT DOCUMENTS

| | | | | |
|---|---|---|---|---|
| 2005/0174308 | A1* | 8/2005 | Matlock | G09G 3/005 345/82 |
| 2013/0187921 | A1* | 7/2013 | Gilbert | G09G 5/36 345/426 |
| 2018/0166006 | A1* | 6/2018 | Cauwood | G09F 9/33 |

FOREIGN PATENT DOCUMENTS

| | | | |
|---|---|---|---|
| CN | 204726221 | U | 10/2015 |
| CN | 207009048 | U | 2/2018 |
| CN | 108001576 | A | 5/2018 |
| CN | 109102773 | A | 12/2018 |
| CN | 109455178 | A | 3/2019 |

* cited by examiner

DISPLAY METHOD FOR WHEEL ROTATION IMAGING DEVICE, ELECTRONIC DEVICE AND STORAGE MEDIUM

CROSS-REFERENCE TO RELATED APPLICATIONS

The present application claims benefit of Chinese Patent Application No. 201910697655.1, filed on Jul. 30, 2019, the contents of which are hereby incorporated by reference in their entirety.

TECHNICAL FIELD

The present disclosure relates to the technical field of display devices, particularly to a POV (persistence of vision) rotation display device mounted on a wheel, and specifically to a display method for a wheel rotation imaging device, an electronic device, and a storage medium.

BACKGROUND

Rotation imaging is a novel LED display technology that replaces traditional progressive scanning with dynamic scanning of mechanical rotation. Most of the existing POV rotation display devices depend on wired power supply and are not designed with low power consumption, while wheels can only be self-powered or powered by lithium batteries. If the devices are directly mounted to hubs for display, the display time will be very short. In addition, too much display in unmanned or sparsely populated areas will result in the display of the devices being valueless, and screen display information cannot be effectively transmitted to observers. Moreover, due to the influence of the external environment and vehicle operation, the quality of display may be affected, and the display needs of users cannot be met.

SUMMARY

Embodiments of the present disclosure provide a display method for a wheel rotation imaging device, an electronic device, and a storage medium, which solve the problems that the display time is short and the transmission of information to pedestrians as much as possible cannot be guaranteed, where a situational mode may be identified according to operation information, then a power consumption mode is selected, and different power consumption modes are selected according to operation conditions, so that the power of the wheel rotation imaging device can be utilized fully and effectively, and pictures are displayed as long as possible; the power consumption mode is adjusted according to different situational modes, and the display is performed according to the actual vehicle condition to meet the requirements of people for display effects; and pictures are displayed in targeted areas where pedestrians and vehicles are dense to improve the practical and commercial value of the device.

In a first aspect, the present disclosure provide a display method for a wheel rotation imaging device, including: acquiring operation information, the operation information including ambient light intensity, wheel speed, vehicle acceleration, current time, current location, and current power; identifying a situational mode of vehicle driving according to the operation information, the situational mode being in one-to-one correspondence with a power consumption mode; and selecting a power consumption mode of the wheel rotation imaging device according to the situational mode, so that the wheel rotation imaging device completes display according to the power consumption mode; the wheel rotation imaging device is mounted on a wheel and can display texts, images or videos as the wheel rotates. In this embodiment, situational modes are distinguished according to the operation information, and then different power consumption modes are selected, so that the power utilization rate is higher, and the user's requirement for the display duration is satisfied. The power consumption mode is adjusted according to different situational modes, and the display is performed according to the actual vehicle condition to meet the requirements of people for display effects.

In some embodiments, the identifying a situational mode of vehicle driving according to the operation information is that the operation information is input into a trained neural network model to identify the situational mode of vehicle driving.

In some embodiments, the neural network model is a BPNN model, where the input layer includes ambient light intensity, wheel speed, vehicle acceleration, current time, current location, and current power; the intermediate layer includes acceleration/deceleration, acceleration/deceleration time interval, running time, and running road segment; and the output layer includes situational modes: day commuting, night commuting traffic jam, night urban commuting without traffic jam, and night suburban commuting without traffic jam.

In some embodiments, the situational modes include day commuting, night commuting traffic jam, night urban commuting without traffic jam, and night suburban commuting without traffic jam; the power consumption modes include off display, lighting effect display, normal image display, and contour image display; the corresponding relationships between the situational modes and the power consumption modes are that: during day commuting, the display of the wheel rotation imaging device is off; during night commuting traffic jam, the wheel rotation imaging device displays the lighting effect that the wheel rotation imaging device does not display pictures, but parts of LED lights are turned on according to a preset logic; during night urban commuting without traffic jam, the wheel rotation imaging device performs normal image display; and during night suburban commuting without traffic jam, the wheel rotation imaging device performs contour image display.

In some embodiments, power thresholds TH1 and TH2 are set, and TH1>TH2; the situational mode of night urban commuting without traffic jam is divided into three situational modes according to the current power, respectively corresponding to three power consumption modes: during night urban commuting without traffic jam, when the current power value is smaller than TH2, the power consumption mode is normal image display with low resolution and low brightness; during night urban commuting without traffic jam, when the current power value is greater than or equal to TH2 and less than TH1, the power consumption mode is normal image display with high resolution and low brightness; and during night urban commuting without traffic jam, when the current power value is greater than or equal to TH1, the power consumption mode is normal image display with high resolution and high brightness.

In some embodiments, the situational mode of night suburban commuting without traffic jam is divided into two situational modes according to the current power, respectively corresponding to two power consumption modes: during night suburban commuting without traffic jam, when the current power value is smaller than TH1, the power consumption mode is contour image display with low resolution and low brightness; and during night suburban commuting without traffic jam, when the current power value is greater than or equal to TH1, the power consumption mode is contour image display with low resolution and high brightness.

In some embodiments, the contour image display includes the following steps: acquiring color image data, and decoding and converting the color image data into color image data of an RGB color space; performing two-dimensional discrete Fourier transform on the color image data of the RGB color space to obtain frequency domain data; filtering the frequency domain data by a high-pass filter; performing two-dimensional discrete Fourier inverse transform on the frequency domain data filtered by the high-pass filter to obtain two-dimensional time domain image data; and completing, by the rotation imaging device, rotation imaging display of a contour of display content according to the received two-dimensional time domain image data.

In some embodiments, the contour image display includes the following steps: acquiring color image data, and decoding and converting the color image data into color image data of an RGB color space; performing color compression on the color image data of the RGB color space, and intercepting the high-bit color data into low-bit color data to obtain color-compressed image data; performing two-dimensional discrete Fourier transform on the color-compressed image data to obtain frequency domain data; filtering the frequency domain data by a high-pass filter; performing two-dimensional discrete Fourier inverse transform on the frequency domain data filtered by the high-pass filter to obtain two-dimensional time domain image data; and completing, by the rotation imaging device, rotation imaging display of a contour of display content according to the received two-dimensional time domain image data. In some embodiments, the contour image display includes the following steps:

acquiring color image data, and decoding and converting the color image data into color image data of an RGB color space; performing color compression on the color image data of the RGB color space, and intercepting the high-bit color data into low-bit color data to obtain color-compressed image data; performing two-dimensional discrete Fourier transform on the color-compressed image data to obtain frequency domain data; filtering the frequency domain data by a high-pass filter; performing two-dimensional discrete Fourier inverse transform on the frequency domain data filtered by the high-pass filter to obtain two-dimensional time domain image data; performing contrast adjustment on the two-dimensional time domain image data to obtain contour image data; and completing, by the rotation imaging device, rotation imaging display of a contour of display content according to the received contour image data. In this embodiment, contour information of an image is extracted by a contour image display method for clear display, thereby effectively extending the display duration of the rotation imaging display device, and meeting user's display requirements.

In some embodiments, the contour image display further includes the step of: intercepting row or column data from the color image data of the RGB color space, the intercepted row or column data replacing the color image data of the original RGB color space. In this embodiment, row or column data is intercepted for display, for example, the portion of the image that is not related to the content is removed, so that the content of the image can be better displayed, and the displayed content is clearer.

In some embodiments, the color compression is to intercept 24-bit color data of RGB888 as 16-bit color data of RGB565 or 8-bit color data of RGB332.

In some embodiments, the two-dimensional discrete Fourier transform is performed on three channels R, G, and B of the image data respectively, or the image data is converted into 8-bit two-dimensional gray image data, and the two-dimensional discrete Fourier transform is performed on the two-dimensional gray image data.

In some embodiments, the contour image display further includes acquiring video stream data and decoding the video stream data to obtain color image data. In this embodiment, the video stream data can be processed, so that the rotation imaging device can complete energy-saving display of videos.

In a second aspect, an embodiment of the present disclosure provides an electronic device, including: a memory; a processor; and one or more computer program modules, the one or more computer program modules being stored in the memory and configured to be executed by the processor, the one or more computer program modules including instructions for implementing the display method for a wheel rotation imaging device according to any of the above embodiments.

In a third aspect, an embodiment of the present disclosure provides a storage medium for storing non-transitory computer readable instructions, when the non-transitory computer readable instructions are executed by a computer, the display method for a wheel rotation imaging device according to any of the above embodiments may be performed.

Compared with the prior art, the present disclosure has the beneficial effects:

The present disclosure provides a display method for a wheel rotation imaging device, an electronic device, and a storage medium, where a situational mode may be identified according to operation information, then a power consumption mode is selected, and different power consumption modes are selected according to operation conditions, so that the power of the wheel rotation imaging device can be utilized fully and effectively, and pictures are displayed as long as possible; the power consumption mode is adjusted according to different situational modes, and the display is performed according to the actual vehicle condition to meet the requirements of people for display effects; and the information of the displayed pictures is different according to different situational modes, and pictures are displayed in targeted areas where pedestrians and vehicles are dense, so that the information can be transmitted to audiences more effectively, and the practical and commercial value of the device is improved.

BRIEF DESCRIPTION OF DRAWINGS

In order to more clearly explain the technical solution in the embodiments of the disclosure, drawings which require to be used in description of the embodiments are simply introduced below, obviously, the drawings in description below are some embodiments of the disclosure, and those having ordinary skill in the art can further acquire other drawings without creative efforts according to those drawings.

DETAILED DESCRIPTION

The technical solution in the embodiments of the disclosure is clearly and completely described in combination with drawings of the embodiments of the disclosure below, and obviously, the described embodiments are part of embodiments of the disclosure rather than all embodiments. Based on the embodiments of the disclosure, all the other embodiments obtained by those having ordinary skill in the art without any creative works are within the protection scope of the disclosure.

The terms 'first', 'second', 'third', 'fourth' and the like in the specification and in the claims of the disclosure are used for distinguishing different objects but not for describing a specific sequence. Furthermore, the terms 'include' and 'have' as well as their any variations are intended to cover a non-exclusive inclusion. For example, a process, method, system, product or equipment including a series of steps or units does not limit steps or units which have been listed, but selectively further includes steps or units which are not listed, or selectively further includes other inherent steps or units for the process, method, product or equipment.

Reference in the specification to 'embodiments' of the disclosure means that a particular feature, structure or characteristic described in connection with the embodiments is included in at least one embodiment of the disclosure. The appearances of the phrase 'the embodiments' in various places in the specification are not necessarily all referring to the same embodiment, nor are separate or alternative embodiments necessarily mutually exclusive of other embodiments. It will be explicitly and implicitly understood by those skilled in the art that the embodiments described in the disclosure can be combined to other embodiments.

In order to further understand the content, features and functions of the disclosure, the following embodiments are given and illustrated with the attached drawings as follows.

First Embodiment

Figure 1:
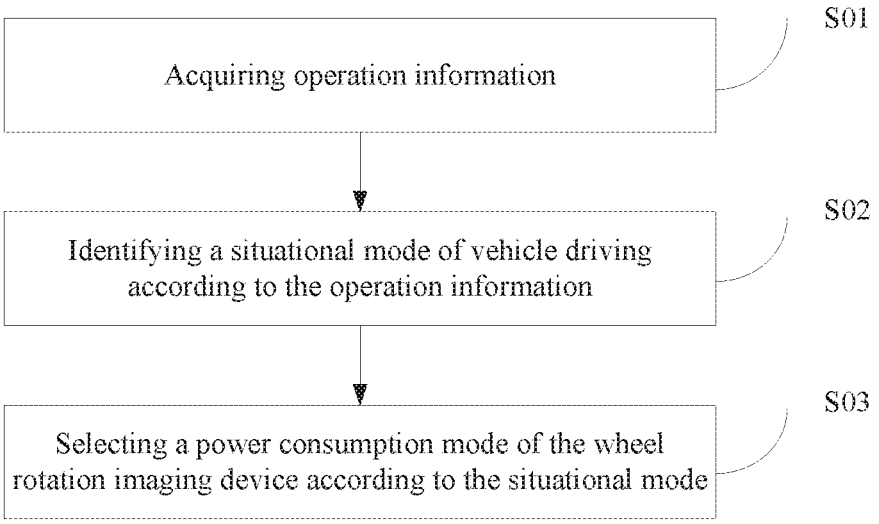
FIG. 1 is a schematic flowchart of a display method for a wheel rotation imaging device according to the present disclosure.

A display method for a wheel rotation imaging device is provided in first embodiment of the present disclosure. As shown in FIG. 1, the method includes:

step S01: acquiring operation information, the operation information including ambient light intensity, wheel speed, vehicle acceleration, current time, current location, and current power;

step S02: identifying a situational mode of vehicle driving according to the operation information, the situational mode being in one-to-one correspondence with a power consumption mode; and step S03: selecting a power consumption mode of the wheel rotation imaging device according to the situational mode, so that the wheel rotation imaging device completes display according to the power consumption mode.

The wheel rotation imaging device is mounted on a wheel and can display texts, images or videos as the wheel rotates. For example, the wheel rotation imaging device includes a photosensitive sensor, a Hall sensor, an accelerometer, a clock module, a positioning module, a power detecting module, a wireless module, a storage module, a core control module, an LED display strip, and a driving module. The core control module is connected to the photosensitive sensor, the Hall sensor, the accelerometer, the clock module, the positioning module, the power detecting module, the wireless module, the storage module and the driving module by signals. The core control module is capable of acquiring ambient light intensity, wheel speed, vehicle acceleration, current time, current location, and current power from the photosensitive sensor, the Hall sensor, the accelerometer, the clock module, the positioning module, and the power detecting module in real time during the vehicle driving process. The LED display strip may include a plurality of LED strips having the same number of LED beads, the LED strips are distributed in the radial direction of the wheel, the plurality of LED strips are converged in the center of the wheel, the core control module of the wheel rotation imaging device receives content information to be displayed through the wireless module and converts the content information to be displayed into a driving signal for driving the LED beads on the LED display strip to light or extinguish in certain time sequence, the core control module transmits the driving signal to the driving circuit, and the driving module drives the LED beads on the LED strips of the LED display strip to light or extinguish in certain time sequence so as to display the content to be displayed as the wheel rotates, where the LEDs may be three-color LEDs, and are capable of displaying colored texts, images and videos, so the display effect is more glaring, and the replacement of display is simple. The wireless module may be a WiFi module, or a 3G, 4G or 5G module, etc. The positioning module may be a GNSS module, a Beidou module, a GPS module, etc., and may also be a positioning module integrated in the wireless module, for example, a GPS module integrated in a 4G/5G module.

Figure 2:
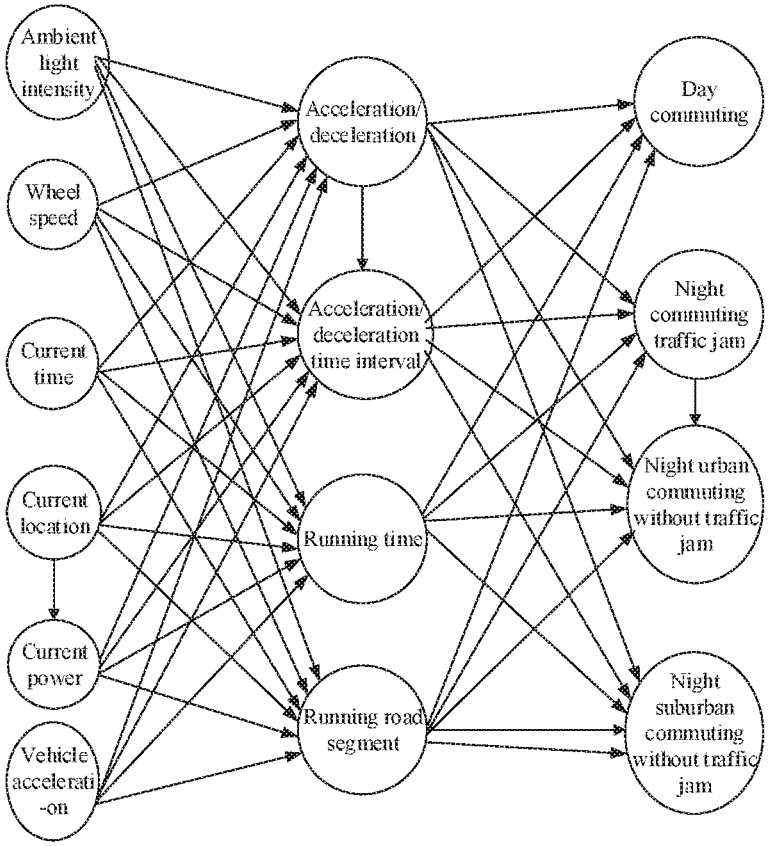
FIG. 2 is a principle diagram of a neural network in the display method for a wheel rotation imaging device according to the present disclosure.

In some embodiments, the situational mode of vehicle driving is identified using a neural network according to the operation information. The situational mode of vehicle driving is identified by inputting the operation information into a trained neural network model. As shown in FIG. 2, the neural network model is a BPNN model, where the input layer includes ambient light intensity, wheel speed, vehicle acceleration, current time, current location, and current power; the intermediate layer includes acceleration/deceleration, acceleration/deceleration time interval, running time, and running road segment; and the output layer includes situational modes: day commuting, night commuting traffic jam, night urban commuting without traffic jam, and night suburban commuting without traffic jam. In the process of algorithm training, coefficient vectors are continuously adjusted by inputting different input vectors, a group with higher credibility is finally obtained to obtain the result of the output layer and judge which situation the vehicle is in, and the situational mode is used as a judgment basis to adjust the power consumption mode of the system. The basic principle of the BPNN model is no longer described in detail here.

Scenes of daily driving will be analyzed. (1) In the normal urban commuting mode, external viewers are close to the vehicle, the viewing effect is good, the stream of people is dense, and the display effect needs to be prioritized. All lights are turned off during the day and turned on at night for display, and the contour image display method is disabled to display complete POV pictures. When the vehicle speed is reduced (due to congestion, intersection waiting or other similar interruptions), the lights are switched to a specific lighting effect (breathing lights, flowing water lights, etc.) because the wheel speed is too low to display pictures. When the vehicle speed is moderate or high (for example, 20 to 80 Km/h), the power is judged; when the power is sufficient, the screen resolution is high resolution, and the brightness is high; when the power decreases to a threshold TH1, the screen resolution is high resolution, and the brightness is reduced; when the power continues to decrease to TH2, the resolution is reduced to low resolution, and the brightness is low. (2) In the normal suburban commuting mode, the external viewers are far away from the wheel, the stream of people is sparse, the viewing effect is not preferentially considered, but the functional difference from the ordinary hub and the endurance are preferentially considered. All lights are turned off during the day and turned on at night for display, and the contour image display method is enabled to display POV pictures. The display screen is closed at the time of insufficient wheel speed (or traffic jam), the lights are switched to a specific lighting effect (breathing lights, flowing water lights, etc.), and pictures processed by the contour image display method are displayed when the wheel speed is appropriate (for example 60 to 120 km/h). In this mode, the screen resolution is always low resolution, the brightness is high only when the power is higher than TH1, and the remaining brightness is low. (3) In the traffic jam situation, it is difficult to display pictures consecutively under frequent start and stop, the endurance and difference are preferentially considered, and the display effect is not considered. At this time, the display screen is closed, and the lighting effect (breathing lights, flowing water lights, etc.) is displayed only according to a preset manner. When the vehicle speed is too high in the above various situational modes, for example, the urban speed >80 km/h and the suburban speed >120 km/h are generally within the range of illegal driving, it is considered to turn off all lights and stop the display of the wheel rotation imaging device.

Figure 3:
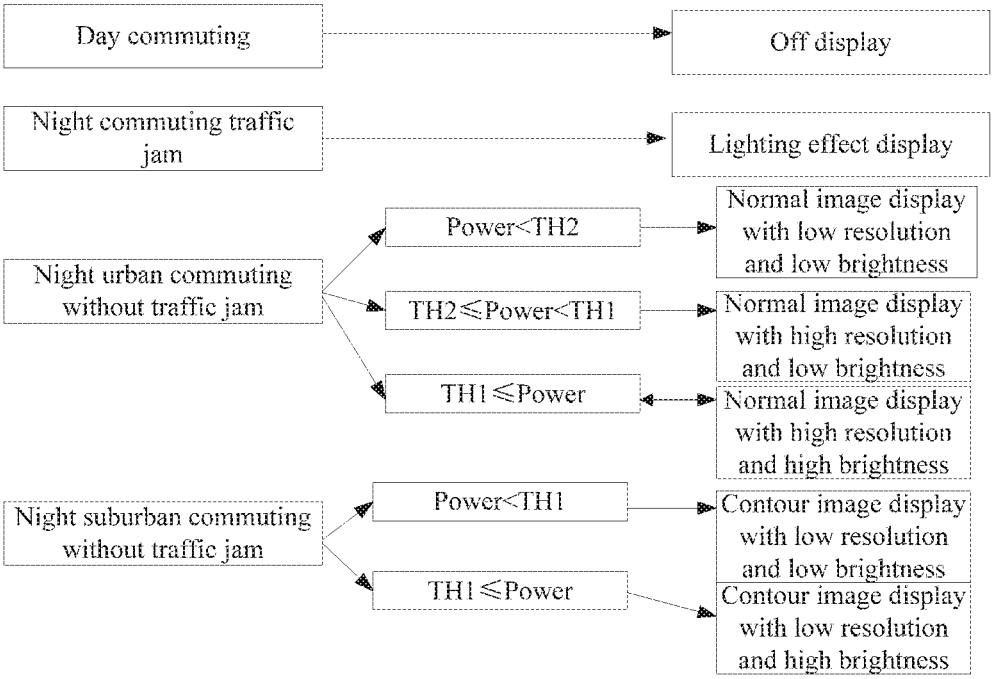
FIG. 3 is a schematic diagram of corresponding relationships between situational modes and power consumption modes in the display method for a wheel rotation imaging device according to the present disclosure.

As shown in FIG. 3, the situational modes include day commuting, night commuting traffic jam, night urban commuting without traffic jam, and night suburban commuting without traffic jam. The power consumption modes include off display, lighting effect display, normal image display, and contour image display. The corresponding relationships between the situational modes and the power consumption modes are: during day commuting, the display of the wheel rotation imaging device is off during night commuting traffic jam, the wheel rotation imaging device displays the lighting effect that the wheel rotation imaging device does not display pictures, but parts of the LED lights, e.g., flowing water lights, breathing lights, horse race lights, etc., are turned on according to a preset logic; during night urban commuting without traffic jam, the wheel rotation imaging device performs normal image display; and during night suburban commuting without traffic jam, the wheel rotation imaging device performs contour image display.

In consideration of power information, power thresholds TH1 and TH2 are set in this embodiment, and TH1>TH2. As shown in FIG. 3, the night urban commuting without traffic jam of the situational modes is divided into three situational modes according to the current power, respectively corresponding to three power consumption modes: during night urban commuting without traffic jam, when the current power value is smaller than TH2, the power consumption mode is normal image display with low resolution and low brightness; during night urban commuting without traffic jam, when the current power value is greater than or equal to TH2 and less than TH1, the power consumption mode is normal image display with high resolution and low brightness; and during night urban commuting without traffic jam, when the current power value is greater than or equal to TH1, the power consumption mode is normal image display with high resolution and high brightness.

As shown in FIG. 3, the night suburban commuting without traffic jam of the situational modes is divided into two situational modes according to the current power, respectively corresponding to two power consumption modes: during night suburban commuting without traffic jam, when the current power value is smaller than TH1, the power consumption mode is contour image display with low resolution and low brightness; and during night suburban commuting without traffic jam, when the current power value is greater than or equal to TH1, the power consumption mode is contour image display with low resolution and high brightness.

In this embodiment, the low resolution and low brightness may be that the image resolution is 160 P, the LED brightness is low, and the power consumption of the wheel rotation imaging device is about 11 W; the low resolution and high brightness may be that the image resolution is 160 P, the LED brightness is high, and the power consumption of the wheel rotation imaging device is about 13 W; the high resolution and low brightness may be that the image resolution is 320 P, the LED brightness is low, and the power consumption of the wheel rotation imaging device is about 15 W; and the high resolution and high brightness may be that the image resolution is 320 P, the LED brightness is high, and the power consumption of the wheel rotation imaging device is about 20 W.

Since the power consumption of the POV display device is related to the LED lights, the power consumption of the overall device is higher if more LEDs are turned on, and the contour image display method turns off the LEDs as much as possible while guaranteeing that viewers can view basic information of images through the POV display device. For an image, the most basic information should be a point, line and surface contour, and the color is further information for each surface. Therefore, the function of the algorithm is to retain the contour of the image, delete or further compress the color information, and display the picture with fewest LEDs. The contour image display is to process the image of POV rotation display, only retain the contour and structure lines of the image and discard all remaining colors or compress the remaining colors into low-bit colors, thereby reducing the power consumption of LED lighting and color change, and saving the power consumption.

Figure 4:
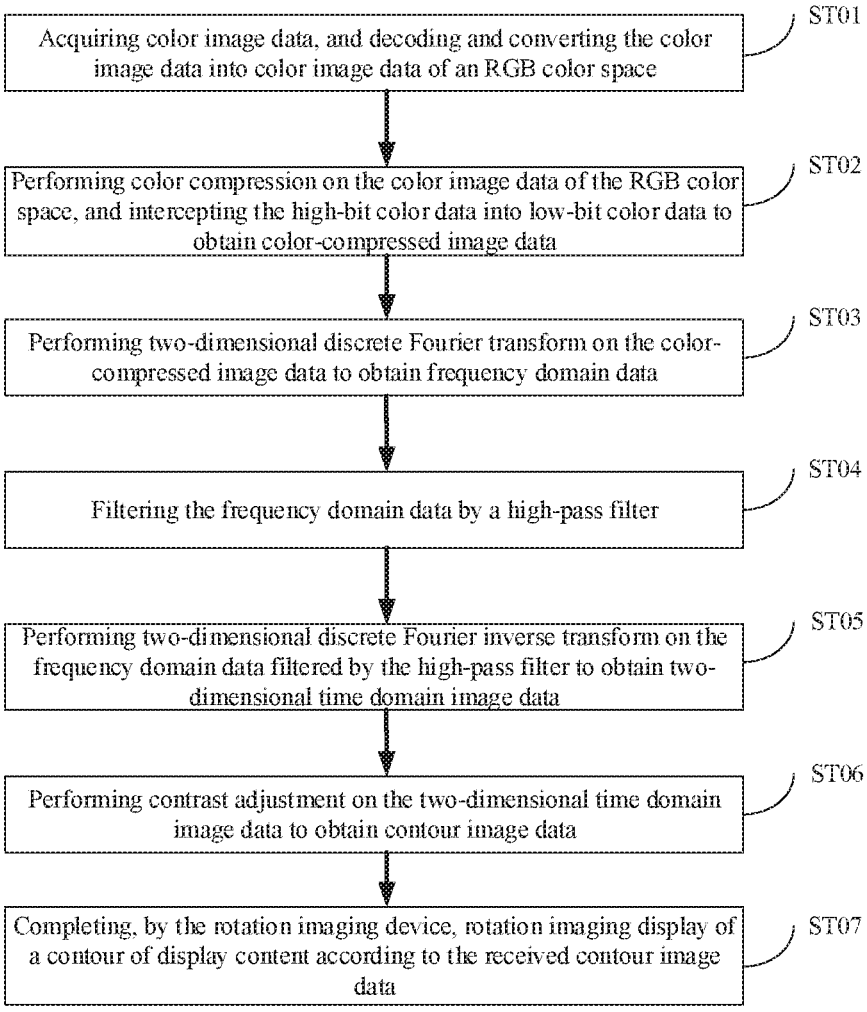
FIG. 4 is a schematic flowchart of a contour image display method in the display method for a wheel rotation imaging device according to the present disclosure.

As shown in FIG. 4, a contour image display method includes:

Step ST01: acquiring color image data, and decoding and converting the color image data into color image data of an RGB color space. The color image data is of a BMP format, a TIFF format, a GIF format, a PNG format, or a JPEG format. The color image data of the RGB color space may be RGB888 (8+8+8=24-bit color), commonly known as 16-megabit true color, or RGB666 (18-bit color), RGB565 (16-bit color), RGB555 (15-bit color), etc.

Step ST02: performing color compression on the color image data of the RGB color space, and intercepting the high-bit color data into low-bit color data to obtain color-compressed image data. For example, the 24-bit color data of RGB888 may be intercepted as 16-bit color data of RGB565 or 8-bit color data of RGB332.

Step ST03: performing two-dimensional discrete Fourier transform on the color-compressed image data to obtain frequency domain data. The two-dimensional discrete Fourier transform on the color-compressed image data is respectively on R, G, and B channels of the color-compressed image data. The principle of two-dimensional discrete Fourier transform is no longer described in detail here. In some other embodiments, the color-compressed image data may be converted into 8-bit two-dimensional gray image data, the two-dimensional gray image data is subjected to two-dimensional discrete Fourier transform, and correspondingly, the time domain image data obtained in the process of inverse Fourier transform is subjected to false color processing or pseudo color processing to obtain color time domain image data. Thus, the amount of computation is greatly reduced, the power consumption of computation is reduced, and more energy is saved.

Step ST04: filtering the frequency domain data by a high-pass filter. The high-pass filter retains high-frequency data points and deletes low-frequency data points, so that the abruptly changing high-frequency data in the image, i.e., the contour, can be retained. In the actual implementation process, the high-pass filter may implement the operation using a threshold comparison judgment method, where a variable a is set, and the image data of a frequency domain after obtained by calculation is compared point by point with a. If a Fourier transform module can perform two-dimensional discrete Fourier transform on the three channels R, G, and B of the color-compressed image data respectively, the root mean square value of the three channels R, G, and B is less than a, and the data is retained, otherwise, the root mean square value is more than a, and the data is assigned with 0. Such effect is that of an ideal high-pass filter with a cutoff frequency of a. Since a is a variable, the value of a can be adjusted in actual use. In some other embodiments, if two-dimensional discrete Fourier transform is performed on the two-dimensional gray image data, the frequency domain data is compared point by point with a.

Step ST05: performing two-dimensional discrete Fourier inverse transform on the frequency domain data filtered by the high-pass filter to obtain two-dimensional time domain image data. The principles of two-dimensional discrete Fourier transform and inverse transform are no longer described in detail here.

Step ST06: performing contrast adjustment on the two-dimensional time domain image data to obtain contour image data. Image contrast is the perception of difference in image color and brightness. If the contrast is larger, the difference between the object of the image and the surrounding is larger. A distinguishing threshold b may be set in actual operation, the color data higher than the distinguishing threshold b is multiplied by a coefficient more than 1, and the color data lower than the distinguishing threshold b is multiplied by a coefficient less than 1, so that the high brightness is higher and the low brightness is lower.

Step ST07: completing, by the rotation imaging device, rotation imaging display of a contour of display content according to the received contour image data. In this embodiment, the wheel rotation imaging device may also adjust the resolution and display brightness through a driving device, for example, during night suburban commuting without traffic jam, when the current power value is smaller than TH1, the power consumption mode is contour image display with low resolution and low brightness; and during night suburban commuting without traffic jam, when the current power value is greater than or equal to TH1, the power consumption mode is contour image display with low resolution and high brightness, the driving device drives the LED display strip according to the control of the core control module to display contour images of different resolution and brightness as the wheel rotates.

In some other embodiments, step ST02 further includes intercepting row or column data from the color image data of the RGB color space, the intercepted row or column data replacing the original color image data. In this way, a color compression module can intercept the main content of pre-display for display, so that the content of the image can be better displayed, and the displayed content is clearer.

In some embodiments, step S01 further includes acquiring video stream data and decoding the video stream data to obtain color image data. In this way, the video stream data can be processed, so that the rotation imaging device can complete energy-saving display of videos. The video stream data is of AVI format, WMV format, RM format, RMVB format, MPEG1 format, MPEG2 format, MP4 format, 3GP format, ASF format, SWF format, VOB format, DAT format, MOV format, M4V format, FLV format, F4V format, MKV format, MTS format, or TS format, and the data transmission physical layer interface may be MIPI, LCD, etc.

In addition, in some embodiments, according to the limitation of hardware resources, for example, a hardware processor has limited ability to process data, one or all of step ST02 and step ST06 in the contour image display method may be omitted at the expense of slight display effect, thereby improving the processing and calculation speed of data, and enabling the display of the rotation imaging device smoother.

Second Embodiment

Figure 5:
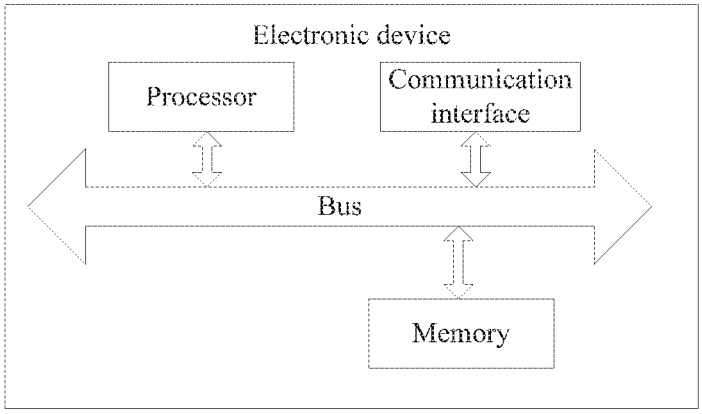
FIG. 5 is a schematic structural diagram of an electronic device according to the present disclosure.

As shown in FIG. 5, the present disclosure also provides an electronic device, including a memory, a processor, and a communication interface. The processor is connected to the memory and the communication interface by signals, and the memory is configured to store non-transitory computer readable instructions (e.g., one or more computer program modules). The processor is configured to run the non-transitory computer readable instructions, the non-transitory computer readable instructions being executable by the processor to perform one or more steps of the display method for a wheel rotation imaging device in any embodiment described above. The memory and the processor may be interconnected by a bus system and/or other form of connecting mechanism (not shown).

For example, the processor may be a central processing unit (CPU), a digital signal processor (DSP), or other form of processing unit with data processing capability and/or program execution capability, such as a field programmable gate array (FPGA); for example, the central processing unit (CPU) may be an X86 or ARM architecture or the like. The processor may be a general-purpose processor or a dedicated processor that can control various modules in the rotation imaging device and other components such as LED strips to perform the desired functions.

For example, the memory may include any combination of one or more computer program products, which may include various forms of computer readable storage media such as a volatile memory and/or a nonvolatile memory. The volatile memory may include, for example, a random access memory (RAM) and/or a cache, etc. The non-volatile memory may include, for example, a read-only memory (ROM), a hard disk, an erasable programmable read-only memory (EPROM), a portable compact disk read-only memory (CD-ROM), a USB memory, a flash memory, etc. One or more computer program modules may be stored on the computer readable storage media, and the processor may run one or more computer program modules to implement various functions of the wheel rotation imaging device, implement and identify different situational modes and select power consumption modes so as to achieve energy-saving display. Various disclosures and various data as well as various data used and/or generated by the disclosures, and the like may also be stored in the computer readable storage media.

For example, in an example, the memory and the processor are located in the wheel rotation imaging device, and may receive video stream data or color image data based on a corresponding communication protocol through a communication interface (e.g., a wired local area network, a wireless local area network, a 3G/4G/5G communication network, Bluetooth, etc.), and the wheel rotation imaging device acquires operation information, identifies a situational mode and selects a power consumption mode to select off display, lighting effect display, normal image display, or contour image display; when the contour image display is selected, the wheel rotation imaging device obtains contour image data of a content to be displayed through a series of processing such as image input, color compression, Fourier transform, high-pass filtering, inverse Fourier transform, and contrast adjustment, and the core control module drives the rotation imaging device according to the obtained contour image data and the resolution and brightness information corresponding to the power consumption mode to complete the rotation imaging display of the contour of the displayed content. The communication protocol may be any applicable communication protocol such as a Bluetooth communication protocol, an Ethernet, a serial interface communication protocol, or a parallel interface communication protocol, which is not limited in the embodiment of the present disclosure. The electronic device may communicate with a server (or a cloud) or a user terminal in a wired or wireless manner.

For example, the memory and the processor may be disposed in the server (or the cloud), and the server (or the cloud) completes the functions of acquiring operation information, identifying a situational mode, selecting a power consumption mode, etc. Of course, the embodiment of the present disclosure is not limited thereto, and the memory, the processor and the like may also be disposed at a client. The functions of acquiring operation information, identifying a situational mode, selecting a power consumption mode, etc. are completed in the client.

Third Embodiment

This embodiment provides a storage medium for storing non-transitory computer readable instructions. When the non-transitory computer readable instructions are executed by a computer, instructions of the display method for a wheel rotation imaging device according to any of the embodiments of the present disclosure may be performed. The storage medium is used to acquire operation information, identify a situational mode and select a power consumption mode to select one of off display, lighting effect display, normal image display, or contour image display in, for example, a rotation imaging device; when the contour image display is selected, the wheel rotation imaging device obtains contour image data of a content to be displayed through a series of processing such as image input, color compression, Fourier transform, high-pass filtering, inverse Fourier transform, and contrast adjustment, and the core control module drives the rotation imaging device according to the obtained contour image data and the resolution and brightness information corresponding to the power consumption mode to complete the rotation imaging display of the contour of the displayed content, so that the power of the wheel rotation imaging device can be utilized fully and effectively, and pictures can be displayed as long as possible. The power consumption mode is adjusted according to different situational modes, and the display is performed according to the actual vehicle condition to meet the requirements of people for display effects. The storage medium may be applied to the rotation imaging device, a user terminal, or a cloud server. For example, the storage medium may be the memory in the electronic device shown in FIG. 5. The related description of the storage medium can be referred to the corresponding description in the second embodiment, and details are no longer described herein again.

The flowcharts and block diagrams in the accompanying drawings illustrate system architectures, functions and operations that may be implemented according to the methods and computer program products of multiple embodiments of the present disclosure. In this regard, each of the blocks in the flowcharts or block diagrams may represent a module, a program segment, or a portion of codes, the module, program segment, or portion of codes including one or more executable instructions for implementing specified logic functions. It should also be noted that, in some alternative implementations, the functions denoted by the blocks may occur in a sequence different from the sequences shown in the figures. For example, any two consecutive blocks may be executed, substantially in parallel, or they may sometimes be in a reverse sequence, depending on the function involved. It should also be noted that each block in the block diagrams and/or flowcharts as well as a combination of blocks in the block diagrams and/or flowcharts may be implemented by a dedicated hardware-based system executing specified functions or operations, or by a combination of a dedicated hardware and computer instructions.

The embodiments of the disclosure are described in detail above, particular examples are used herein to explain the principle and embodiments of the disclosure, and the above description of the embodiments is only used to help understanding the methods and core concept of the disclosure; and meanwhile, for those having ordinary skill in the art, according to the idea of the disclosure, there will be changes in the specific implementation mode and disclosure scope, in conclusion, the contents of the specification shall not be construed as a limitation of the disclosure.

The invention claimed is:

1. A display method for a wheel rotation imaging device, comprising:

acquiring operation information, the operation information comprising ambient light intensity, wheel speed, vehicle acceleration, current time, current location, and current power;

identifying a situational mode of vehicle driving according to the operation information, the situational mode being in one-to-one correspondence with a power consumption mode; and selecting a power consumption mode of the wheel rotation imaging device according to the situational mode, so that the wheel rotation imaging device completes display according to the power consumption mode;

wherein the wheel rotation imaging device is mounted on a wheel and is configured to display texts, images or videos as the wheel rotates;

the identifying a situational mode of vehicle driving according to the operation information comprises inputting the operation information into a trained neural network model to identify the situational mode of vehicle driving; and the trained neural network model is a back-propagation neural network (BPNN) model, where an input layer comprises ambient light intensity, wheel speed, vehicle acceleration, current time, current location, and current power; an intermediate layer comprises acceleration/deceleration, acceleration/deceleration time interval, running time, and running road segment; and an output layer comprises situational modes comprising day commuting, night commuting traffic jam, night urban commuting without traffic jam, and night suburban commuting without traffic jam.

2. The display method for a wheel rotation imaging device according to claim 1, wherein: the situational modes comprise day commuting, night commuting traffic jam, night urban commuting without traffic jam, and night suburban commuting without traffic jam; the power consumption modes comprise off display, lighting effect display, normal image display, and contour image display, the corresponding relationships between the situational modes and the power consumption modes are that: during day commuting, a display of the wheel rotation imaging device is off; during night commuting traffic jam, the wheel rotation imaging device displays the lighting effect that the wheel rotation imaging device does not display pictures, but parts of light emitting diode (LED) lights are turned on according to a preset logic; during night urban commuting without traffic jam, the wheel rotation imaging device performs normal image display; and during night suburban commuting without traffic jam, the wheel rotation imaging device performs the contour image display.

3. The display method for a wheel rotation imaging device according to claim 2, wherein the contour image display comprises the following steps:

acquiring color image data, and decoding and converting the color image data into color image data of a red-green-blue (RGB) color space;

performing two-dimensional discrete Fourier transform on the color image data of the RGB color space to obtain frequency domain data;

filtering the frequency domain data by a high-pass filter;

performing two-dimensional discrete Fourier inverse transform on the frequency domain data filtered by the high-pass filter to obtain two-dimensional time domain image data; and completing, by the wheel rotation imaging device, rotation imaging display of a contour of display content according to the two-dimensional time domain image data.

4. The display method for a wheel rotation imaging device according to claim 3, wherein the contour image display further comprises the step of: before the performing two-dimensional discrete Fourier transform, performing color compression on the color image data of the RGB color space, and intercepting high-bit color data into low-bit color data to obtain color-compressed image data.

5. The display method for a wheel rotation imaging device according to claim 4, wherein the contour image display further comprises the step of: after the performing two-dimensional discrete Fourier inverse transform, performing contrast adjustment on the two-dimensional time domain image data to obtain contour image data.

6. The display method for a wheel rotation imaging device according to claim 4, wherein the color compression is to intercept 24-bit color data of RGB888 as 16-bit color data of RGB565 or 8-bit color data of RGB332.

7. The display method for a wheel rotation imaging device according to claim 3, wherein the contour image display further comprises the step of: intercepting row or column data from the color image data of the RGB color space, the row or column data replacing the color image data of the RGB color space.

8. The display method for a wheel rotation imaging device according to claim 3, wherein the contour image display further comprises the step of: acquiring video stream data and decoding the video stream data to obtain the color image data.

9. The display method for a wheel rotation imaging device according to claim 2, wherein power thresholds TH1 and TH2 are set, and TH1>TH2; the situational mode of night urban commuting without traffic jam is divided into three situational modes according to the current power, respectively corresponding to three power consumption modes:

during night urban commuting without traffic jam, when a current power value is smaller than TH2, the power consumption mode is normal image display with low resolution and low brightness;

during night urban commuting without traffic jam, when the current power value is greater than or equal to TH2 and less than TH1, the power consumption mode is normal image display with high resolution and low brightness; and during night urban commuting without traffic jam, when the current power value is greater than or equal to TH1, the power consumption mode is normal image display with high resolution and high brightness.

10. The display method for a wheel rotation imaging device according to claim 9, wherein the situational mode of night suburban commuting without traffic jam is divided into two situational modes according to the current power, respectively corresponding to two power consumption modes:

during night suburban commuting without traffic jam, when the current power value is smaller than TH1, the power consumption mode is contour image display with low resolution and low brightness; and during night suburban commuting without traffic jam, when the current power value is greater than or equal to TH1, the power consumption mode is contour image display with low resolution and high brightness.

11. The display method for a wheel rotation imaging device according to claim 10, wherein the contour image display comprises the following steps:

acquiring color image data, and decoding and converting the color image data into color image data of a red-green-blue (RGB) color space;

performing two-dimensional discrete Fourier transform on the color image data of the RGB color space to obtain frequency domain data;

filtering the frequency domain data by a high-pass filter;

performing two-dimensional discrete Fourier inverse transform on the frequency domain data filtered by the high-pass filter to obtain two-dimensional time domain image data; and completing, by the wheel rotation imaging device, rotation imaging display of a contour of display content according to the two-dimensional time domain image data.

12. The display method for a wheel rotation imaging device according to claim 11, wherein the contour image display further comprises the step of: before the performing two-dimensional discrete Fourier transform, performing color compression on the color image data of the RGB color space, and intercepting high-bit color data into low-bit color data to obtain color-compressed image data.

13. The display method for a wheel rotation imaging device according to claim 12, wherein the contour image display further comprises the step of: after the performing two-dimensional discrete Fourier inverse transform, performing contrast adjustment on the two-dimensional time domain image data to obtain contour image data.

14. The display method for a wheel rotation imaging device according to claim 12, wherein the color compression is to intercept 24-bit color data of RGB888 as 16-bit color data of RGB565 or 8-bit color data of RGB332.

15. The display method for a wheel rotation imaging device according to claim 11, wherein the contour image display further comprises the step of: intercepting row or column data from the color image data of the RGB color space, the row or column data replacing the color image data of the RGB color space.

16. The display method for a wheel rotation imaging device according to claim 11, wherein the contour image display further comprises the step of: acquiring video stream data and decoding the video stream data to obtain the color image data.

17. An electronic device, comprising:

a memory;

a processor; and one or more computer program modules, the one or more computer program modules being stored in the memory and configured to be executed by the processor, the one or more computer program modules comprising instructions for implementing a display method for a wheel rotation imaging device, wherein the display method comprises:

acquiring operation information, the operation information comprising ambient light intensity, wheel speed, vehicle acceleration, current time, current location, and current power;

identifying a situational mode of vehicle driving according to the operation information, the situational mode being in one-to-one correspondence with a power consumption mode; and selecting a power consumption mode of the wheel rotation imaging device according to the situational mode, so that the wheel rotation imaging device completes display according to the power consumption mode;

wherein the wheel rotation imaging device is mounted on a wheel and is configured to display texts, images or videos as the wheel rotates;

the identifying a situational mode of vehicle driving according to the operation information comprises inputting the operation information into a trained neural network model to identify the situational mode of vehicle driving; and the trained neural network model is a back-propagation neural network (BPNN) model, where an input layer comprises ambient light intensity, wheel speed, vehicle acceleration, current time, current location, and current power; an intermediate layer comprises acceleration/deceleration, acceleration/deceleration time interval, running time, and running road segment; and an output layer comprises situational modes comprising day commuting, night commuting traffic jam, night urban commuting without traffic jam, and night suburban commuting without traffic jam.

18. A non-transitory computer readable storage medium for storing instructions, when the instructions are executed by a computer, a display method for a wheel rotation imaging device is configured to be performed, wherein the display method comprises:

acquiring operation information, the operation information comprising ambient light intensity, wheel speed, vehicle acceleration, current time, current location, and current power;

identifying a situational mode of vehicle driving according to the operation information, the situational mode being in one-to-one correspondence with a power consumption mode; and selecting a power consumption mode of the wheel rotation imaging device according to the situational mode, so that the wheel rotation imaging device completes display according to the power consumption mode;

wherein the wheel rotation imaging device is mounted on a wheel and is configured to display texts, images or videos as the wheel rotates;

the identifying a situational mode of vehicle driving according to the operation information comprises inputting the operation information into a trained neural network model to identify the situational mode of vehicle driving; and the trained neural network model is a back-propagation neural network (BPNN) model, where an input layer comprises ambient light intensity, wheel speed, vehicle acceleration, current time, current location, and current power; an intermediate layer comprises acceleration/deceleration, acceleration/deceleration time interval, running time, and running road segment; and an output layer comprises situational modes comprising day commuting, night commuting traffic jam, night urban commuting without traffic jam, and night suburban commuting without traffic jam.

* * * * *